US006354720B2

(12) United States Patent
Grossman et al.

(10) Patent No.: US 6,354,720 B2
(45) Date of Patent: Mar. 12, 2002

(54) SCISSORS WORKLIGHT

(75) Inventors: M. Gary Grossman, Riverside, CT (US); Pei Sheng Qian, Shanghai (CN); Brian L. Spitler, Elon College, NC (US)

(73) Assignee: Regent Lighting Corporation, Burlington, NC (US)

( * ) Notice: Subject to any disclaimer, the term of this patent is extended or adjusted under 35 U.S.C. 154(b) by 0 days.

(21) Appl. No.: 09/799,960

(22) Filed: Mar. 6, 2001

Related U.S. Application Data

(63) Continuation of application No. 09/320,259, filed on May 26, 1999.
(60) Provisional application No. 60/086,764, filed on May 26, 1998.

(51) Int. Cl.[7] ..... F21S 8/08
(52) U.S. Cl. ..... 362/427; 362/413; 362/414

(58) Field of Search ..... 362/285, 287, 362/413, 418, 427, 190, 191, 414, 450; 248/454, 463, 474

(56) References Cited

U.S. PATENT DOCUMENTS 1,326,650 A * 12/1919 Doerr ..... 362/396
1,367,369 A * 2/1921 Friend ..... 362/191
6,139,164 A * 10/2000 Bolta et al. ..... 362/418

* cited by examiner

*Primary Examiner*—Y. My Quach-Lee
(74) *Attorney, Agent, or Firm*—Niro, Scavone, Haller & Niro

(57) ABSTRACT

A portable worklight having at least two base sections that are operable between open and closed positions. The base sections are pivotally connected and when in a closed position, the base sections nest together. When in an open position, the base sections support said worklight in an upright position by providing opposingly located support sections.

3 Claims, 1 Drawing Sheet

SCISSORS WORKLIGHT

This application is a continuation of application Ser. No. 09/320,259, filed May 26, 1999, which claims priority to U.S. Provisional Patent Application No. 60/086,764 filed May 26, 1998.

BACKGROUND OF THE INVENTION

The invention relates to a portable worklight, and more specifically, a portable worklight that uses a foldable stand that collapses inwardly to produce a slim-profile light that is compact for storage purposes.

SUMMARY OF THE INVENTION

In the field of portable worklights there is a competing design consideration between the need for a sturdy base to support the worklight and the need to provide a compact design for ease of storage. A sturdy base with a wide foot print is desirable so that the light is placed in the most stable position possible. On the other hand, the wider the foot print of the base, the more space is required to store the worklight. The present invention provides a solution to both competing design considerations. It provides two frames that are pivotally connected and extend between open and closed positions. In an open position, the frames provide a base which supports the worklight. In a closed position, the frames nest together to reduce the space needed to store the device.

Consequently, an object of the present invention is to provide a worklight with foldable frames or base sections that act as a base when in an open position and which nest together when in a closed position for ease of storage.

BRIEF DESCRIPTION OF THE DRAWINGS

The novel features which are characteristic of the present invention are set forth in the appended claims. However, the invention's preferred embodiment, together with further objects and attendant advantages, will be best understood by reference to the following detailed description taken in connection with the accompanying drawings in which:

DETAILED DESCRIPTION OF THE PREFERRED EMBODIMENT

Set forth below is a description of what is currently believed to be the preferred embodiment or best example of the invention claimed. Future and present alternatives and modifications to the preferred embodiment are contemplated. Any alternates or modifications in which insubstantial changes in function, in purpose, in structure or in result are intended to be covered by the claims of this patent.

Figure 1:
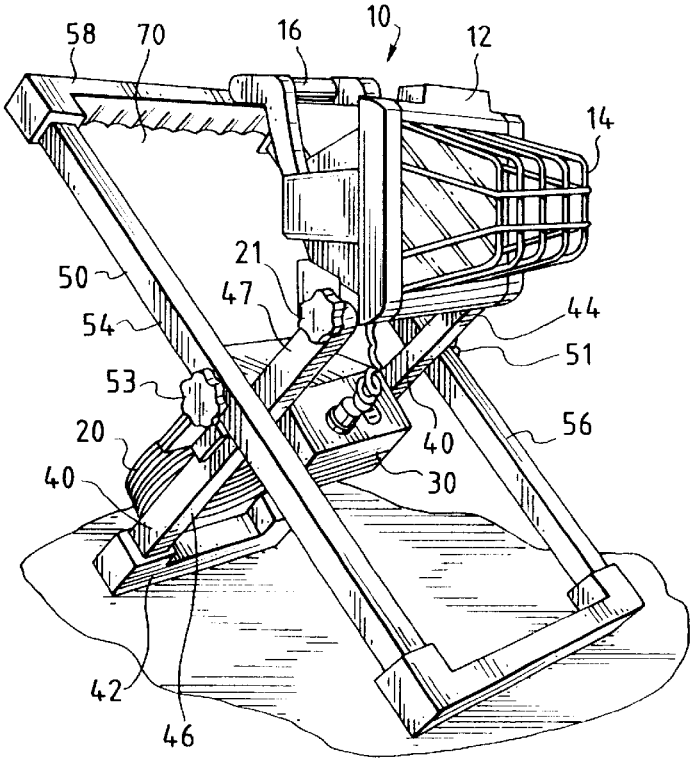
FIG. 1 is a front perspective view of one embodiment of the present invention.
Figure 3:
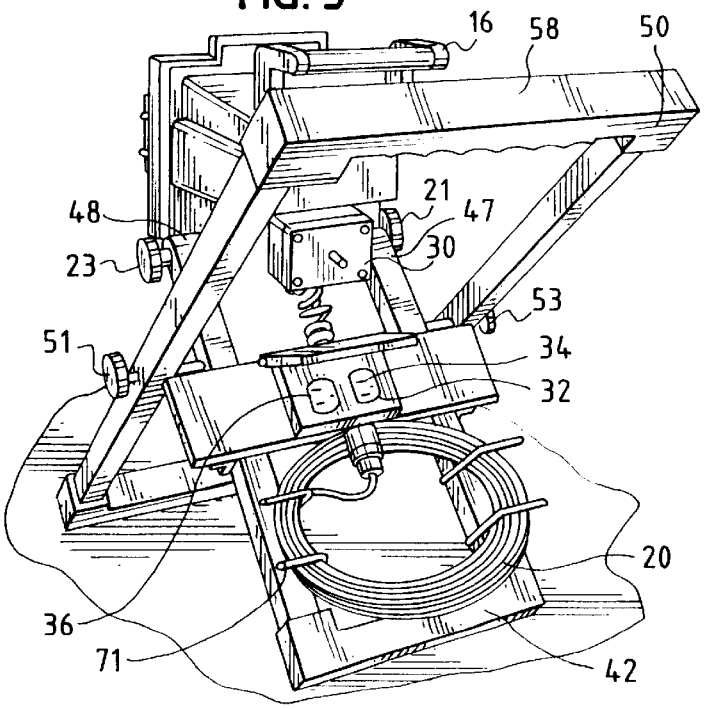
FIG. 3 is a rear perspective view of the embodiment shown in FIG. 1.

As shown in FIG. 1, the worklight 10 of the present invention includes a light housing 12 which contains a lamp (not shown), grill 14, and handle 16 and the other components needed to create a working light. Light housing 12 is pivotally connected to first frame or base section 40 by fasteners 21 and 23. As shown in FIGS. 1 and 3, a switch 30 is connected to light housing 12 and electrical receptacle 32 for the electrical operation of the lamp. Receptacle 32 may also include external outlets 34 and 36 which may be used to energize other electrical devices. An extension cord 20 may also be provided to energize the light and outlets 34 and 36 and which may stored on holder 71. First frame or base section 40 is pivotally connected to second frame or base section 50 by fasteners 51 and 53.

As shown, the frames may be rectangular or square-like in configuration or in other shapes which may nest together. Frame 40 has a base portion 42, opposing sides 44 and 46 and free ends 47 and 48 to which light housing 12 is pivotally connected. Frame 50 is similarly constructed with a base 52, opposing sides 54 and 56 and top 58. The overall length and width of first frame 40 with attached light housing 12 is sized to fit within second frame 50. Configuring the frames in this manner permits the frames to pivot, scissor-like, about fasteners 51 and 53 between open and closed positions.

Figure 2:
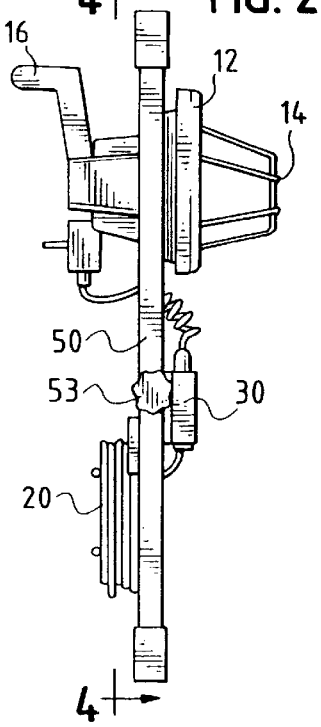
FIG. 2 is a side view of the embodiment shown in FIG. 1.
Figure 4:
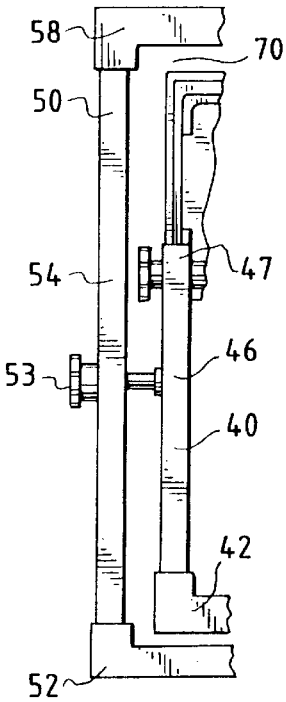
FIG. 4 is a partial front view taken along line 4—4.

In an open position, bases 42 and 52 are opposing located and form a support upon which the worklight rests in an upright position. In a closed position, the frames or base sections nest together as shown in FIGS. 2 and 4. This reduces the foot print of the base as well as the total space occupied by the worklight. This, in turn, makes it easier to store the light.

In use, the frames or base sections are moved from a closed position as shown in FIG. 2 to an open position as shown in FIG. 1. Extension cord 20 is then connected to an outlet which energizes receptacle 32 which, in turn, and in combination with switch 30, operates to energize the lamp. To return the device to storage, the frames or base sections are directed inwardly until nested. The device then may be hung on a support surface by inserting a hook or a similar object through opening 70 which is located between top 58 and light housing 12.

It should be understood that various changes and modifications to the preferred embodiment described would be apparent to those skilled in the art. Changes and modifications can be made without departing from the spirit and scope of the present invention and without diminishing its intended advantages. It is, therefore, intended that such changes and modifications be covered by the following claims.

What is claimed is:

1. A portable worklight operable between open and closed positions comprising:

a light housing comprising a light source;

an outer base section and an inner base section;

said outer base section has four legs which form a frame, and said inner base section comprising two opposingly located legs located in between said legs of said outer base section;

said light housing attached to said legs of said inner base section;

said legs of said base sections pivotally connected;

in said closed position, said base sections nest together with said frame formed by said outer base section surrounding said light housing and said inner base section; and in said open position, said base sections support said light housing in an upright position.

2. The apparatus of claim 1 wherein said inner base section includes a third leg which results in the formation of a three-sided frame.

3. The apparatus of claim 1 wherein said outer legs are longer in length than said inner legs.

* * * * *